US005232425A

United States Patent [19]

Miller et al.

[11] Patent Number: 5,232,425

[45] Date of Patent: Aug. 3, 1993

[54] PIVOTABLE ABDOMINAL EXERCISE DEVICE

[76] Inventors: Jack V. Miller, 1977 E. Villa St., Pasadena, Calif. 91107; Ned Gvoich, 4466 Lakeside Dr., P.O. Box 126, Beamsville, Ontario, Canada, L0R 1B1

[21] Appl. No.: 969,431

[22] Filed: Oct. 30, 1992

[51] Int. Cl.[5] ..... A63B 21/02

[52] U.S. Cl. ..... 482/121; 482/125; 482/126; 482/140

[58] Field of Search ..... 482/128, 129, 121, 124, 482/126, 140, 907, 908, 112, 125, 73; 434/253

[56] References Cited

U.S. PATENT DOCUMENTS

| | | | |
|---|---|---|---|
| 3,132,861 | 11/1964 | Horney . | |
| 4,211,404 | 7/1980 | Blowsky et al. . | |
| 4,351,527 | 9/1982 | Crisp . | |
| 4,517,966 | 5/1985 | von Othegraven | 482/125 |
| 4,580,778 | 4/1986 | Van Noord | 482/121 |
| 4,603,858 | 8/1986 | Reehil . | |
| 4,606,541 | 8/1986 | Kirkpatrick | 482/129 |
| 4,736,946 | 4/1988 | Gordon . | |
| 4,743,011 | 5/1988 | Coffey | 482/73 |
| 4,824,105 | 4/1989 | Goldenberg . | |
| 4,863,162 | 5/1989 | Neckamm et al. . | |
| 4,865,317 | 9/1989 | Hickey . | |
| 4,903,963 | 2/1990 | Garnett . | |
| 4,951,941 | 8/1990 | Resk . | |
| 5,005,832 | 4/1991 | Van Der Hoeven . | |
| 5,033,742 | 7/1991 | Johnson et al. . | |
| 5,046,726 | 9/1991 | Van Straaten . | |
| 5,069,448 | 12/1991 | Shyu . | |
| 5,071,119 | 12/1991 | Johnson . | |

FOREIGN PATENT DOCUMENTS

| | | | |
|---|---|---|---|
| 0030512 | 6/1981 | European Pat. Off. | 482/908 |

*Primary Examiner*—Richard J. Apley
*Assistant Examiner*—Jeanne M. Mollo
*Attorney, Agent, or Firm*—Small Larkin & Kidde

[57] ABSTRACT

A device for exercising the abdominal muscles which facilitates movement of the lower torso against a resistive force and in a complex arc which conforms to the normal forward arc of rotation of the spine comprising: a rigid shaft slidably disposed within a housing; arcuate thigh supports for maintaining the housing stationary with respect to a person's thighs; a handle generally transverse to and attached to a first shaft end; an elastic band positioned intermediate the ends of the shaft and for connecting the housing to a second shaft end so as to generate a resistive restoring force by pressing on the handle so as to displace the shaft relative to the housing in a direction from the first shaft end to the second shaft end, thereby executing a downstroke; a pivot positioned intermediate the ends of the shaft and for pivoting the upper portion of the shaft away from the torso as a downstroke is executed; a stop member for limiting displacement of the shaft with respect to the housing as the shaft moves in a direction from the second shaft end to the first shaft end, as an upstroke is completed; and a plurality of elastic bands for altering the amount of resistive restoring force.

11 Claims, 9 Drawing Sheets

FIG. 15.
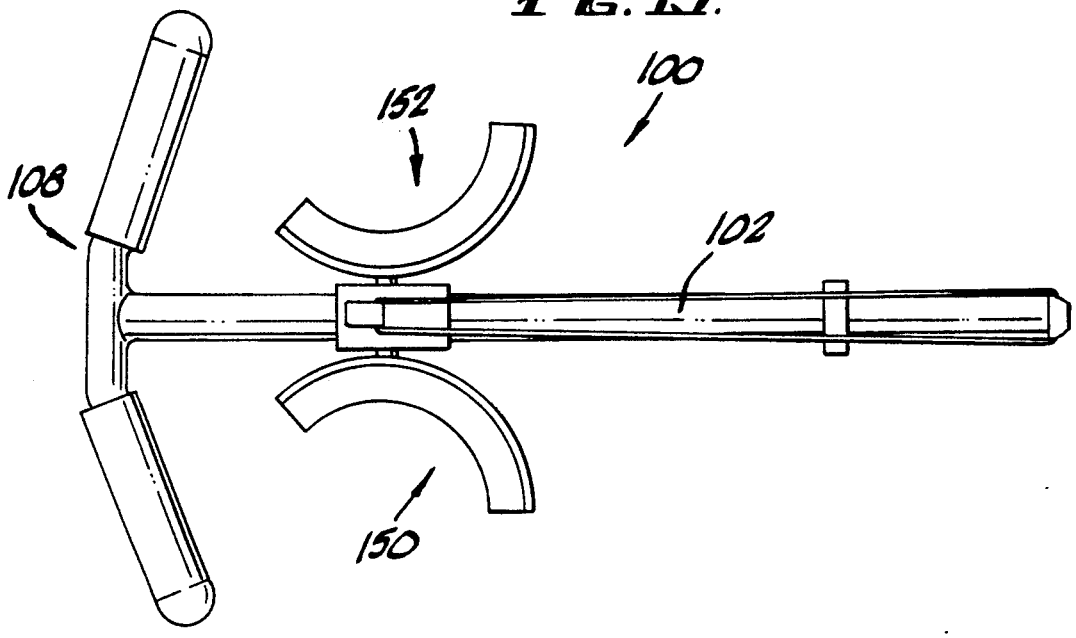
FIG. 16.
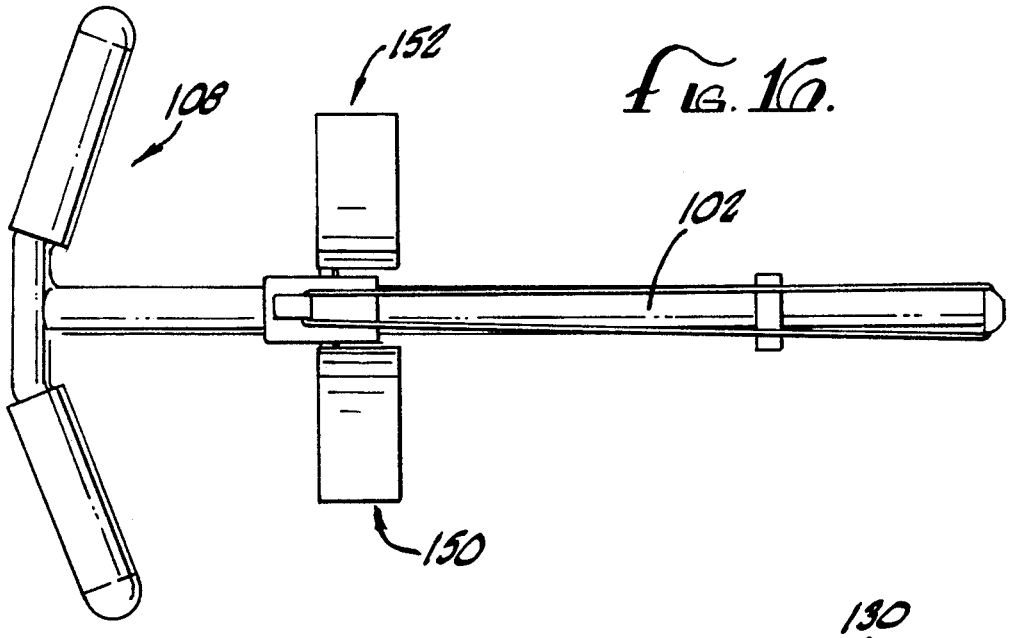
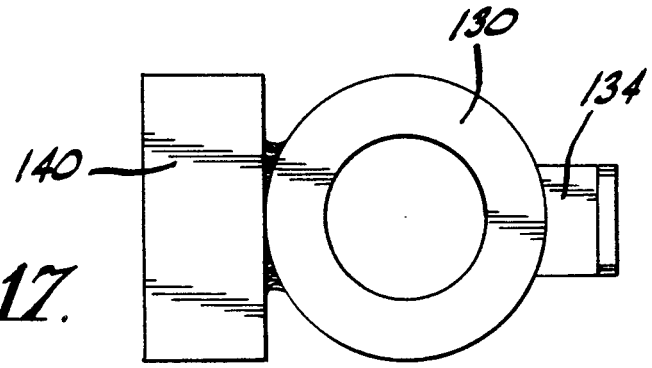
FIG. 17.

FIG. 18.
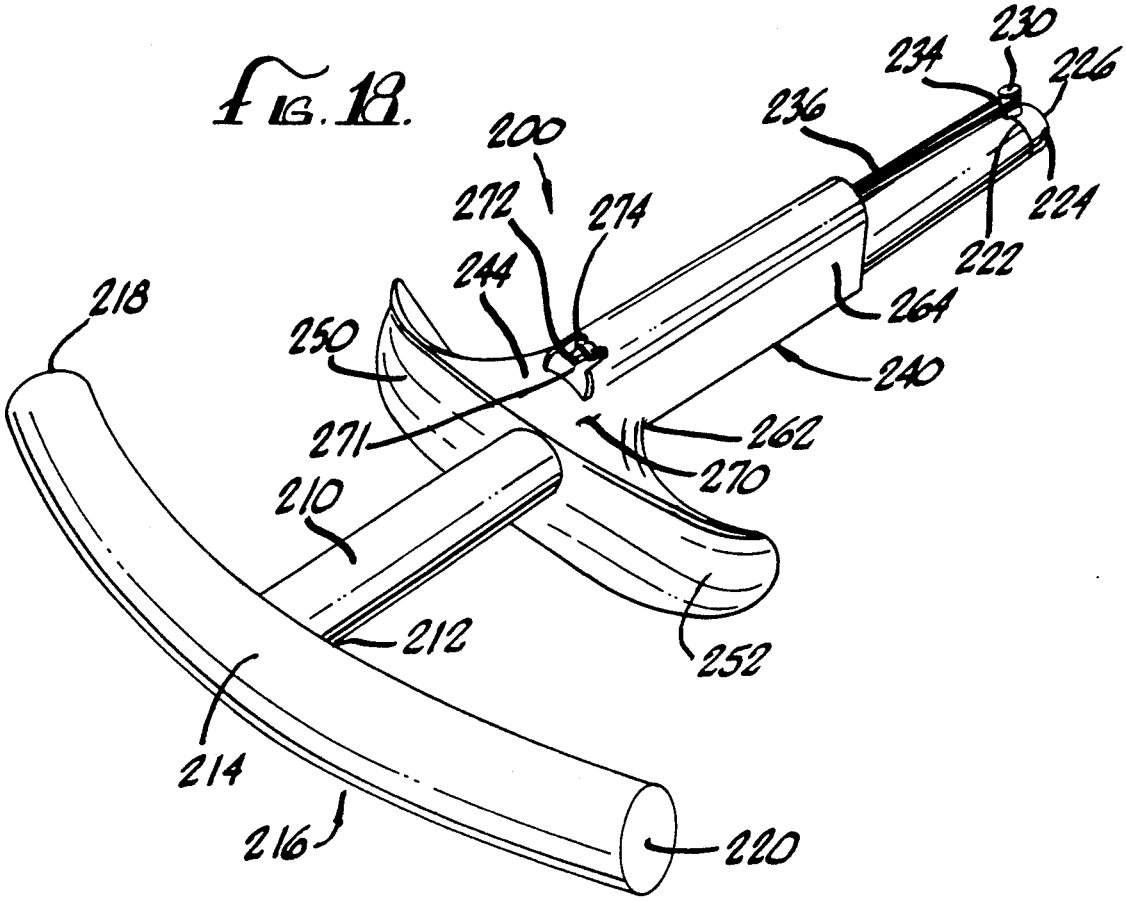
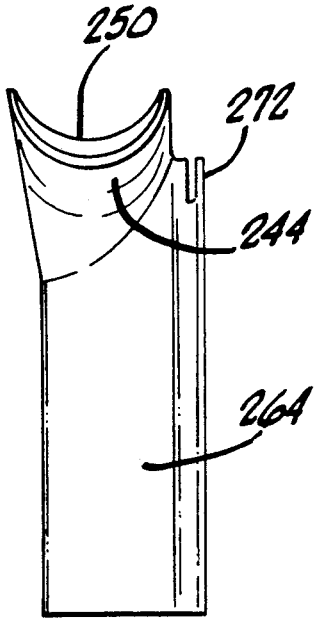
FIG. 21.
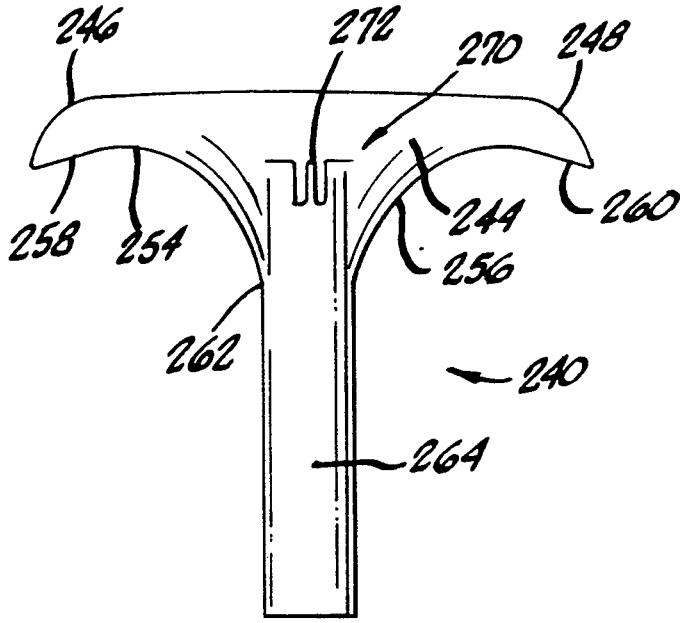
FIG. 20.

PIVOTABLE ABDOMINAL EXERCISE DEVICE

BACKGROUND OF THE INVENTION

1. Field Of The Invention

This invention relates to an exercise device for exercising all of the major muscles comprising the upper and lower abdomen, without putting undue stress on the lumbar and cervical spinal discs and the muscles comprising the lower back and hip flexors.

It is well-known in the fitness industry that exercises which can optimally strengthen and tone the principal muscles in the abdominal region preferably are specific to particular muscles and/or to portions of those muscles.

The principal abdominal muscles include the *rectus abdominus, obliquus internus abdominis* and *obliquus externus abdominis,* which are more fully described as follows:

1. The rectus abdominus muscles are a pair of long flat muscles, one on either side of the navel, which extend along the whole length of the front of the abdomen from the lower rib cage to the front of the iliac and pubic bones of the pelvis. The rectus abdominus muscles are interconnected by the linea alba, a band of fibrous connective tissue.

2. The obliquus externus abdominis muscles (external obliques) are broad, thin, flat muscles situated on the lateral and anterior parts of the abdomen and attached by fibrous connective tissue to the abdominus rectus. They extend from the medial margins of the lower rib cage and are directed outwardly toward the rim of the iliac bone of the pelvis.

3. The obliquus internus abdominis muscles (internal obliques) are thinner and smaller than the obliquus externus muscles. The internal obliques lie beneath and transversely to the external obliques. The internal obliques extend from the lateral margins of the lower rib cage and are directed inwardly toward the rim of the pelvic iliac bone. The internal obliques are also attached to the abdominus rectus muscles by fibrous connective tissue.

The upper portion of the rectus abdominus can be effectively exercised by performing repetitions of "sit-ups" using the "crunch" technique. In this context, "crunch" refers to the motion in which the trunk of the human body is raised from a supine position, i.e.,, flexed, in a curling motion, while the spine is flexed so that the anterior portion of the spine is concave while the posterior portion of the spine is convex, and with the legs remaining straight or bent. The lumbar spine movements are predicated predominately by the orientation of the facet joints. The facet joints are true diarthrodial joints complete with synovium and joint capsules. In the lower lumbar spine the facet orientation is predominately in the sagital plane and less and less sagitally oriented toward the coronal plane angulation of the thoracic spine facets toward the upper lumbar spine.

The primary movement in the lumbar spine is therefore flexion and extension with rotation limited when the facets are engaged. As the front flexes forward, the facets are disengaged in the mid-range of flexion thereby permitting slight vertebral rotation. As the trunk flexes past the mid-range of trunk flexion, the facet joints are once again engaged thereby restricting the extent of vertebral rotation. As described in H. F. Farfan, *Mechanical Disorders of the Lower Back,* Lea & Febizer (1973), at pages 31–32 and 43–44, the facet joints of the lumbar spine have a vertical orientation, and the joint surfaces face each other and are almost parallel, but with a slight inclination to the anterior-posterior (A-P) plane. In successively lower lumbar levels, the facets assume an increasing reorientation so that joint surfaces of superior facets at the lumbosacral level face upwards, inwards and backwards. The orientation of the facets may be described as increasing inclinations, with descent down the spine of the facet joint, to two planes at right angles to each other. Because the surfaces of the joints have compound curvatures and it is therefore very difficult to assign an angle or plane of orientation for a given joint. Moreover, there is considerable variation in orientation from individual to individual. When the intervertebral joints are subjected to the stress of weight-bearing or of motion, small movements of the joints, known as "strain deflections" result. The point about which a given joint moves is the center of rotation. However, because this point may change with the movement, the point is referred to as "the instantaneous center of rotation." As emphasized in *Farfan,* it is "generally conceded that it is virtually impossible to have a pure movement in any of the three principal planes. The orientation of the facet surfaces generally does not coincide with the plane of the motion and therefore modifies the motion of the intervertebral joint. This is more certainly true of rotation than it is for flexion or extension. In an individual with symmetrical vertebrae, movements in the A–P plane may be free of either lateral bend or rotation. However, rotation is not possible without some degree of flexion and lateral bend." Thus, with reference to Farfan, it may be seen that the "crunch" motion, even in an individual with a symmetric spine, defines a complex curve or arc for a given joint as the spine is rotated through its entire range of motion. The profile of the spine itself, as it is rotated through the entire range of motion, also defines a family of complex curves. At any single instant, the locus of points on each joint of the spine will define a complex curve which, at each point, is orthogonal to the complex curve defined by the joint itself as it rotates.

The lower portion of the rectus abdominus can be effectively exercised by performing repetitions of the "knee-up" exercise in which the knees are lifted in an arcing motion toward the chest wall. "Knee-up" exercise refers to that motion of rotation of the legs, with the knees facing up and bent, and while the person is lying on the ground or floor.

The external obliques and internal obliques are best exercised by performing repetitions of a twisting, or rotary, crunch motion. Such a motion occurs during a sit-up exercise with the torso alternately twisted to the right and left, thereby pulling into action, respectively, the right obliquus externus and left obliquus internus, and the left obliquus externus and right obliquus internus.

As conventionally performed, these exercises are not without hazard and inconvenience. For example, performing sit-ups while keeping the legs straight risks injury and pain due to undue stress on the lower back regions. There is also danger of straining the hip flexor muscles, difficulty of controlling or adjusting muscular resistance, and, in some circumstances, discomfort and inconvenience associated with lying on the floor. Performing knee-ups in the conventional fashion also risks injury to the lower back and hips. Unless the knees are kept bent, the back is always curved and the abdominal muscles are tensed, thereby increasing the stress to the lower spine. This is the purpose for adopting a knees-bent posture in the conventional crunch technique for doing sit-ups. Furthermore, extreme twisting of the torso while performing rotary sit-ups can overstress the small facet joints of the lower spine which by the nature of their orientation prohibit rotation of the spine, thereby risking strain of the facet joints and overstressing the obliquus externus and obliquus internus muscles, resulting in soreness and pain in the rib walls. This case is most exaggerated when the spine is postured in the extremes of extension of flexion ranges of motion.

Therefore, to minimize the risk of injury as well as achieve a greater level of comfort and control compared to that resulting from performing abdominal exercises while lying on the floor, there has been a need for a device and/or technique whereby a person sitting in a chair can use the crunch motion while performing repetitions of exercises equivalent to sit-ups, rotary sit-ups and/or knee-ups, but while remaining within safe limits of stress to the back and to the abdominal muscles.

Various resistance-type exercise devices for exercising abdominal muscles are known. However, it has been found that when a person undertakes a program of conditioning the abdominal muscles by systematic use of such a device, that person often soon abandons the program because the resistance is so great as to allow performing only a few repetitions before fatigue sets in, or so small that the muscles are not adequately stressed regardless of how many repetitions are done. Even if the resistance is initially in an appropriate range for a user's muscular strength, he or she may find that as his or her muscles become stronger through exercise, that a conditioning plateau is reached where the set resistance is insufficient to provide further strengthening, thereby necessitating a need for a means to progressively increase or vary the resistance.

As is well-known, the preferred method for strengthening muscles is exercise using progressively increasing resistance because this places increasing demand on muscles and prevents them from accommodating to a specific force. Thus, to enable a resistance-type device to be used effectively by people having different strength, and to enable an individual who progresses through an exercise program to remain challenged as his or her strength increases, there is also a need for an abdominal exercise device which not only meets the above-stated criteria, but also one in which resistance can be conveniently increased or decreased.

2. Description Of The Related Art

Devices for exercising the abdominal muscles are known. For example, U.S. Pat. No. 5,069,448 to Shyu discloses a device which in use a person sitting on a chair alternately bends and straightens as well as twists the upper portion of his body when moving and turning a handle upward and downward, the handle being attached to a piston rod within a pneumatic cylinder which is positioned vertically between the person's thighs.

U.S. Pat. No. 5,046,726 to Van Straaten discloses a device which in use a person sitting on a chair, standing, or lying on the back with knees bent, applies a pumping action to a plunger, compressing a spring in a cylinder positioned vertically between the thighs or pressed against the abdomen.

U.S. Pat. No. 5,071,119 to Johnson discloses a device which in use a person sitting on a chair with the chin at the height of a horizontal pushbar attached to a vertical column pivotally supported on the floor places the arms over the pushbar and pushes down against the resistive force of a spring in the column, while twisting the upper portion of the body to the right and left, and then slowly allows the spring's resistive force to push his trunk upward to resume the original upright position.

U.S. Pat. No. 4,863,162 to Neckamm, et al. discloses a spring-loaded piston and cylinder assembly device which during use a transverse handle bar attached to a rod is pushed through the spring-loaded pipe. The pipe is attached at its lower end to a transverse support rod resting on the thighs of the user, the rod being slidably disposed within the pipe.

These above-described devices constrain a person to execute what are largely linear vertical motions or other motions which deviate in some respects from the natural, complex curvature motions of the spine during bending, so that bending of the torso, at least at some points within the full range of motion, occurs at the hips rather than at the lower spine and stomach, thereby predominantly stressing the hip joint flexor muscles rather than the abdominal muscles in these ranges. These motions are in sharp contrast to the crunch motion in which the spine is flexed forward in a curling path, and which motion is fully permitted by the present invention over the entire range of motion of the spine. The abdominal muscles consequently do not receive optimum benefit from use of conventional exercise devices.

OBJECTS OF THE INVENTION

Accordingly, it is an object of the present invention to provide a device for exercising the abdominal muscles without over-stressing the muscles of the lower back and the hip flexor muscles.

Another object of the invention is to provide a device which permits the upper body to move forward under stress, in an arc configuration so as to enable a user to easily assume and maintain the crunch motion during exercise.

A further object of the invention is to provide a device which enables performing crunch-type exercises for the upper body over a full range of motion.

Yet another object of the invention is to provide a device which facilitates performing repetitions of exercises equivalent to sit-ups, rotary sit-ups and/or knee-ups using the crunch conformation.

A still further object of the invention is to provide a device which inhibits overstressing the muscles of the lower back and abdomen while exercises equivalent to sit-ups, rotary sit-ups and/or knee-ups are repetitively performed.

Another object of the invention is to provide an abdominal device whose resistance can be easily adjusted so as to accommodate users of different strength, and also provide a means of progressive resistance exercise for any individual user.

Yet another object of the invention is to provide a device enabling exercise movements not limited by any of a user's body parts or by adjacent furniture.

A further object of the invention is to provide a device which is light-weight and compact so as to accommodate packing and carrying in a conventional travel suitcase.

One more object of the invention is to provide a system that is relatively simple and inexpensive to manufacture, yet reliable.

Other objects of the invention will become evident when the following description of this invention is considered with the accompanying drawings.

SUMMARY OF THE INVENTION

The present invention overcomes inadequacies of conventional abdominal exercising techniques and devices by providing an adjustable, light-weight, compact and easy to use resistance-type device for exercising the abdominal muscles and which enables a user to easily assume and maintain the crunch motion during an exercise routine.

Accordingly, in general terms the device includes: a rigid shaft slidably disposed within a housing; a means for anchoring, i.e., maintaining a stationary position of the housing with respect to a user's thighs; a handle generally transverse to and attached to an upper end of the shaft; an elastic band or other resistance means for connecting the housing to a lower end of the shaft so as to generate a resistive restoring force when the shaft is displaced relative to the housing by the user pressing downwardly on the handle to execute a downstroke; and a means positioned intermediate the ends of the shaft and for smoothly pitching or rotating the shaft forward in an arcing motion as the user executes the downstroke while the body executes the crunch motion. The abdominal exercise device of the present invention may also include a means for limiting displacement of the shaft with respect to the housing at the completion of an upstroke, and means for altering the amount of resistive restoring force.

In more detail, a first preferred embodiment of the present invention comprises: a rigid tubular shaft rigidly connected at an upper end to a middle portion of a tubular "T"-shaped joint member to which is rigidly connected at each of two opposite portions handle member disposed within a close-fitting sheath; a cylindrical housing concentric with and rigidly attached along a lower portion of the shaft, including an upper end surface and further including a lower end portion to which is rigidly connected a hook which is connected to an end of an elastic band; a block-shaped housing positioned intermediate the ends of the shaft, including a collar portion and a pivot assembly retainer portion, the collar portion including a circular bore within which the shaft is slidably disposed, and further including a lower end surface, the displacement of the shaft with respect to the block-shaped housing being limited during an upstroke by the upper end surface of the cylindrical housing contacting the lower end surface of the collar portion of the block-shaped housing, and the pivot assembly retainer portion including a lower surface to which is rigidly attached a hook connected to an opposite end of the elastic band; a pivot assembly including a cylindrical axle disposed and smoothly rotatable within a concave recess of the pivot assembly retainer portion, the axle connected at opposed ends to a pair of arcuately-shaped thigh support pieces, the support pieces also being interconnected by a rigid cross-piece member, the thigh support pieces, the axle and the cross-piece member fabricated as an integral unit.

A second preferred embodiment comprises: a rigid tubular shaft rigidly attached at an upper end to a generally transverse mid-section of a tubular push-bar which extends downwardly at each of two opposite sides in a hand-grip, the shaft having an annular ring rigidly attached proximate to a lower end which is rigidly attached to a first connector to which is connected an end of an elastic band; a cylindrical housing intermediate the ends of the shaft and within which the shaft is slidably disposed, having a second connector mounted on its outer surface to which is attached the opposite end of the elastic band; a pivot assembly comprising a cylindrical tube through which passes a smoothly rotatable bushing, the tube being transversely rigidly connected at its mid-section to the housing; and a pair of arcuately-shaped thigh support pieces, each support piece rigidly connected to a bushing end, the support pieces being interconnected by a rigid cross-piece member.

A third preferred embodiment comprises: a rigid tubular shaft rigidly attached at an upper end to a generally transverse mid-section of an arcuately-shaped concavely downward push-bar, the shaft terminating at a lower end in a cap and at its lower end having a first connector to which is attached an end of an elastic band; a yoke intermediate the ends of the shaft and having a generally horizontal bilateral flange-shaped upper portion, each flange having a lower surface which in an outer portion is convexly curved in the front-to-rear direction when the lower surface rests transversely across a user's thighs and which in an inner portion is, so as to generally fit the thigh contour, concavely curved at the junction of the upper yoke portion with a vertical lower yoke portion having a generally oblate ellipsoidal cross-section, the yoke including throughout its length a cylindrical longitudinal bore within which the shaft is slidably disposed, and the lower yoke portion including therethrough a longitudinal channel, within which is disposed the elastic band, terminating at an upper end in a connector to which is attached an opposite end of the elastic band, and terminating at a lower end in a circular hole.

A more complete understanding of the present invention and other objects, aspects and advantages thereof will be gained from a consideration of the following description of the preferred embodiments read in conjunction with the accompanying drawings provided herein.

BRIEF DESCRIPTION OF THE DRAWINGS

FIG. 15 is a top plan view of the FIG. 13 embodiment where the thigh support members in FIG. 14 are aligned parallel to a rigid shaft.

FIG. 16 is a top plan view of the FIG. 13 embodiment Where the thigh support members in FIG. 14 are aligned perpendicular to the shaft.

FIG. 17 is a top plan view of the FIG. 14 pivot assembly housing and the collar, including a projection for retaining an elastic band.

FIG. 18 is a perspective view of a third preferred embodiment.

FIG. 20 is a front elevational view of the yoke of the FIG. 18 embodiment.

FIG. 21 is a side elevational view of the yoke of the FIG. 20 embodiment.

DESCRIPTION OF THE PREFERRED EMBODIMENTS

Figure 1:
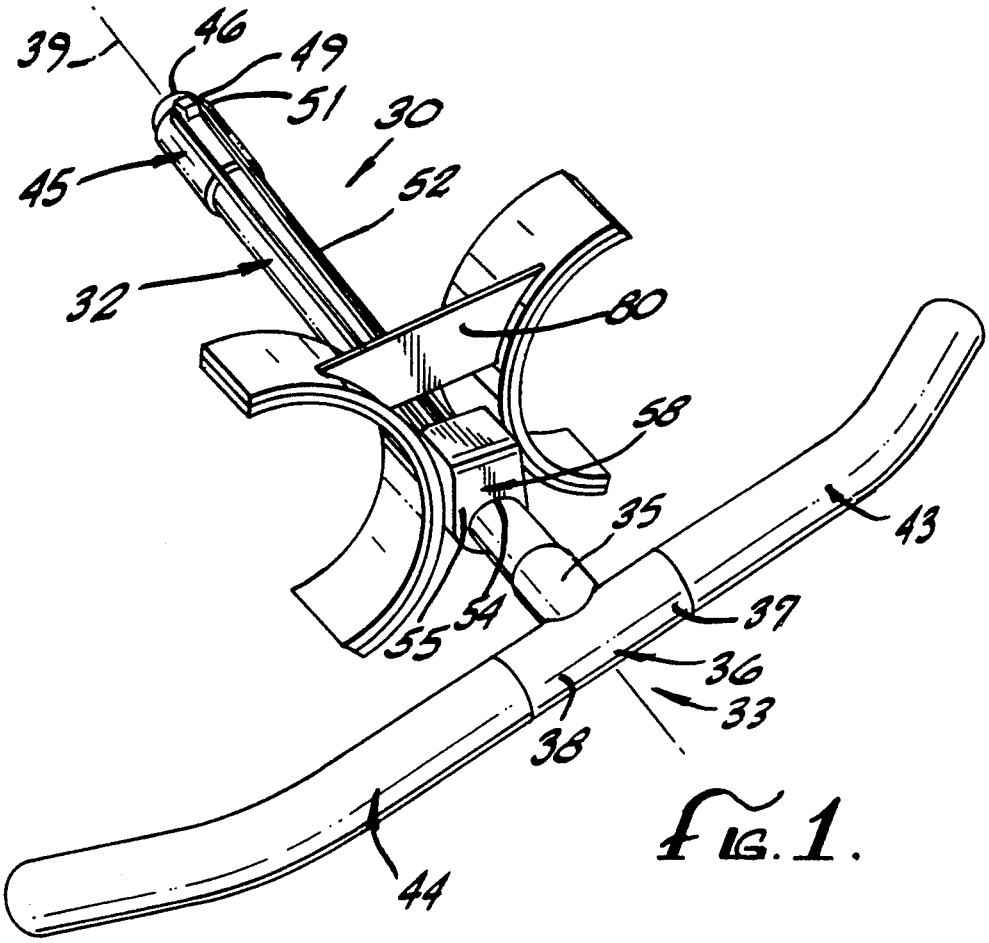
FIG. 1 is a perspective view of a first preferred embodiment.

While the present invention is open to various modifications and alternative constructions, the preferred embodiments shown in the drawings will be described herein in detail. It is to be understood, however, there is no intention to limit the invention to the particular form disclosed. On the contrary, it is intended that the invention cover all modifications, equivalences and alternative constructions falling within the spirit and scope of the appended claims.

First Preferred Embodiment

The first preferred embodiment of the abdominal exercise device of the present invention will be described with reference to FIGS. 1–12.

As shown in FIGS. 1–4, an abdominal exercise device 30 includes a rigid shaft 32 of predetermined length sufficient to permit a full range of exercise of the abdominal muscles and extending along a first axis 39 shown in broken lines the direction of upper left-hand to lower right-hand corners of FIG. 1. The shaft 32 is preferably tubular in cross-section, but can be made using any other cross-sectional configuration so long as the shaft cooperates with other components of the device to permit exercise of the abdominal muscles. The shaft is also preferably fabricated from a rigid plastic material such as polypropylene, although virtually any other rigid material, such as wood, metal or other plastics, may be used.

Figure 2:
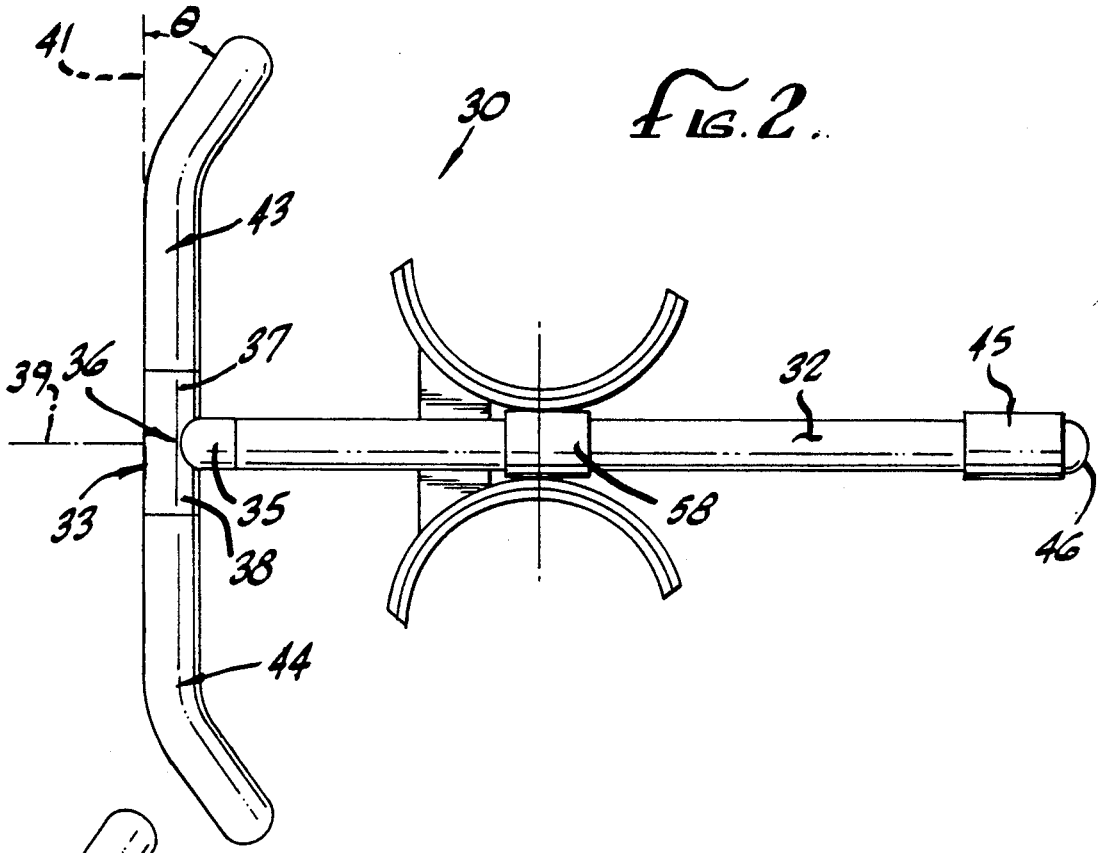
FIG. 2 is a top plan view of the FIG. 1 embodiment, including a pair of thigh support members aligned parallel to a rigid shaft.
Figures 4, 10:
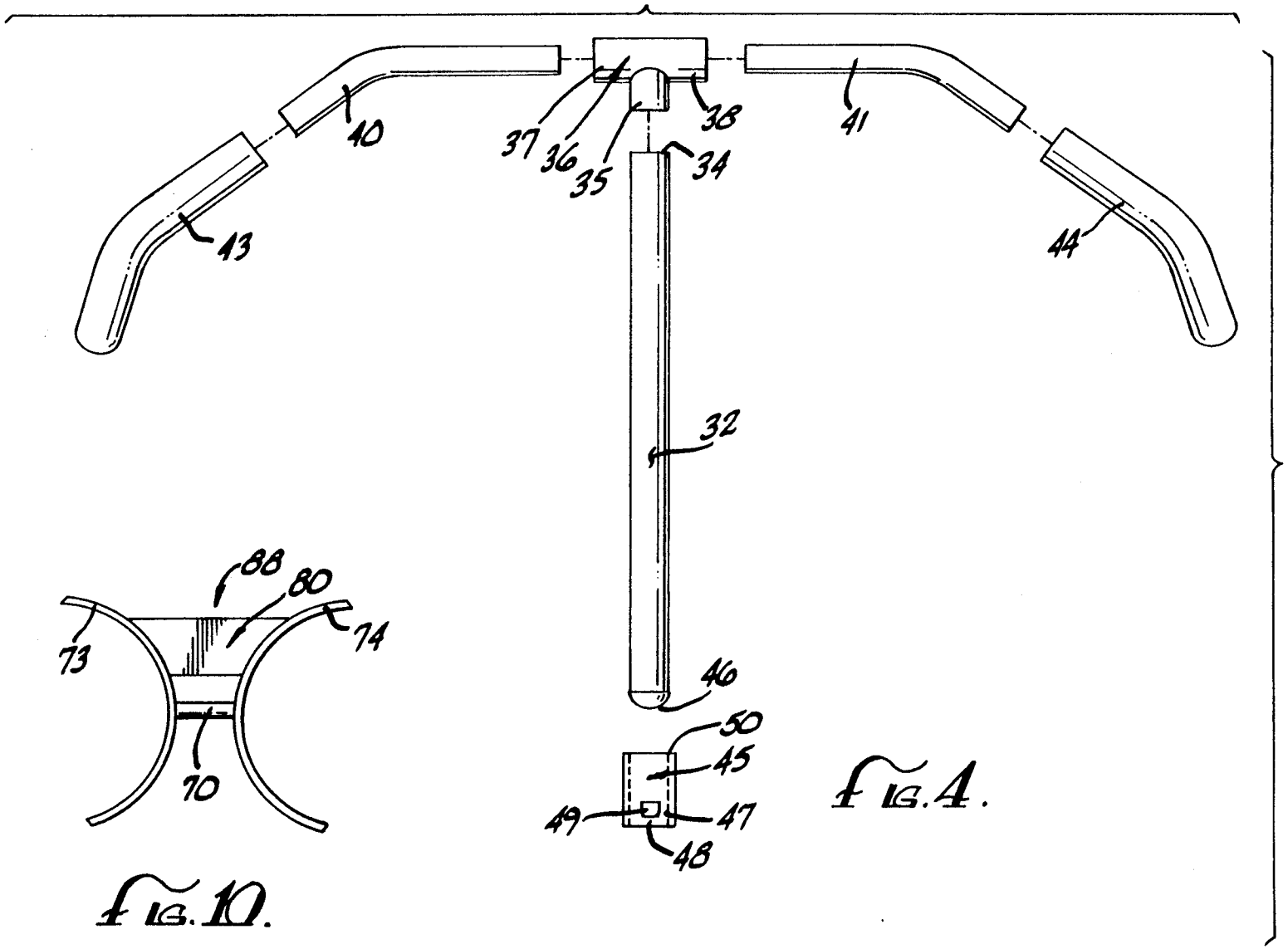
FIG. 4 is an exploded bottom plan view of the shaft, a T-section, a pair of handle members, a pair of handle member sheaths, and a cylindrical housing, of the FIG. 1 embodiment.
FIG. 10 is a top plan view of a one-piece unit including an axle, a pair of thigh support member portions, and a cross-piece member of the FIG. 1 embodiment.

Referring to FIGS. 2 and 4, a handle 33 is rigidly connected to first end 34 at end 34 of the shaft 32 and extends in both directions from the end 34 along a second axis 41, shown in broken lines and which is perpendicular to the first axis 39. The direction of the second axis 41 is shown in FIG. 1 as extending in the direction of upper-right to lower-left. The handle 33 comprises a tubular "T"-shaped push T-joint 36 and opposed first and second handle members 40 and 41, which are made from a rigid material. The T-joint 36 has a first portion 37, a second portion 38 and a third portion 35 for rigid connection to the first handle member 40, second handle member 41 and shaft 32, respectively. In the preferred embodiment, the joint 36 is tubular and receives the tubular first handle member 40, tubular second handle member 41, and tubular shaft 32. The shaft, handle members and T-joint are connected to each other by any conventional means, such as press fit, gluing, or, alternatively, may be made of a one-piece, integral construction.

Distal ends of the handle members 40 and 41 are shown extending at an angle theta ($\theta$), as shown in FIG. 2, to permit greater ease during operation of the device. Although the first embodiment is shown with the handle members at an angle $\theta$, both straight, that is, without an angle, and angled handles are preferred.

The handle members 40, 41 are disposed, respectively, within first and second close-fitting sheaths 43 and 44. Sheaths 43, 44 are preferably fabricated from a conventional polyurethane foam material. Any material which will provide a convenient, durable and comfortable gripping function may be used.

At an opposite, or second end 46 of the shaft 32, a cylindrical housing 45 is concentric with and is rigidly attached to and over the shaft 32. Housing 45 is also preferably fabricated from a hard plastic material, although virtually any other rigid material may be used.

Figure 5:
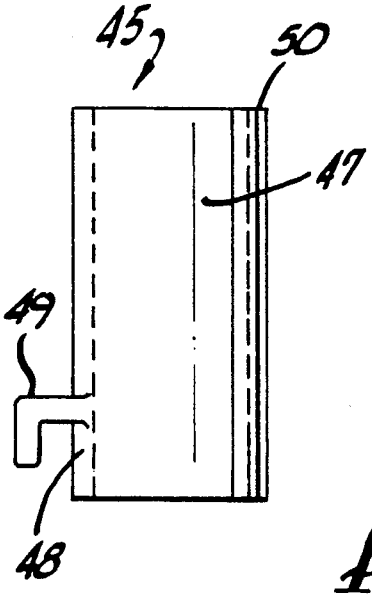
FIG. 5 is a side elevational view of a cylindrical housing, of the FIG. 1 embodiment.
Figure 6:
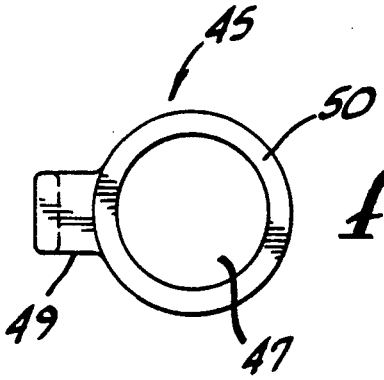
FIG. 6 is a top plan View of the FIG. 5 cylindrical housing.

As shown in FIGS. 4, 5 and 6, the housing 45 includes a bore 47 and a lower end portion 48, which integrally includes a first hook 49, and further includes an upper end surface 50. The housing 45 and hook 49 form a retainer sub-assembly, whereby the housing 45 functions to hold the hook 49 and to retain the shaft 32 from over-extension during upstroke of the shaft.

Figure 3:
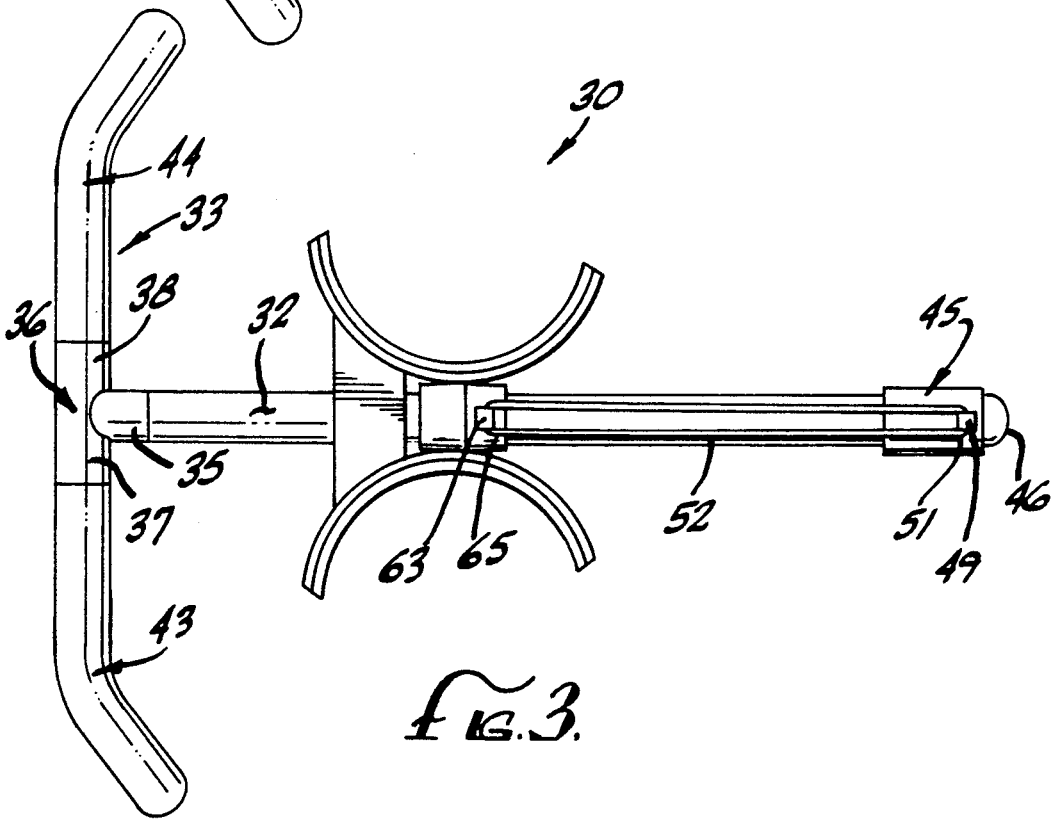
FIG. 3 is a bottom plan view of the FIG. 1 embodiment, including the thigh support members aligned parallel to the rigid shaft.

Referring again to FIGS. 1 and 3, a large, elastomeric band 52 is used to provide a resistive and restoring force for operation of the exercise device. The elastomeric band 52 may be a large-sized, conventional rubber band, or may be simply a length of a tube or band of elastomeric material. The band(s) 52 may be placed on the front or back of the shaft. Virtually any elastomeric material may be used so long as it has properties of strength and elasticity sufficient to function as a resistive and restoring force during operation of the device, as will be described in greater detail hereinafter. Furthermore, in accordance with the principles of the present invention, it is contemplated that a selection of elastomeric bands 52, of differing degrees of elasticity and strength, will be provided with the exercise device so that the user may select and employ a band 52 to provide the desired resistive force for a given exercise session. Alternatively, a plurality of bands of the same or different strengths may be used simultaneously to achieve a desired total resistive force. As shown in FIGS. 1 and 3, a first end 51 of elastic band 52 is looped over hook 49 of housing 45, and a second end 65 of elastic band 52 is looped over a second hook 63 positioned on housing 58, which now will be described in greater detail.

Referring to FIG. 1, shaft 32 is slidably disposed within a circular bore 54 of a collar portion 55 of a block-shaped housing 58, which is positioned to slide along the shaft but intermediate its ends. To permit sliding and to prevent binding of the shaft 32 within the bore 54, shaft 32 and housing 58 are fabricated from dissimilar materials or a material which permits sliding. Furthermore, housing 58 is preferably fabricated from a silicone-impregnated plastic material sold under the name Delrin. Although various materials and various constructions such as, for example, use of roller bearings inside of the housing 58 may be employed to permit sliding of the shaft 32 freely within the collar portion 55 of housing 58, it is preferred that this function be achieved through choice of materials which permit sliding.

Figure 8:
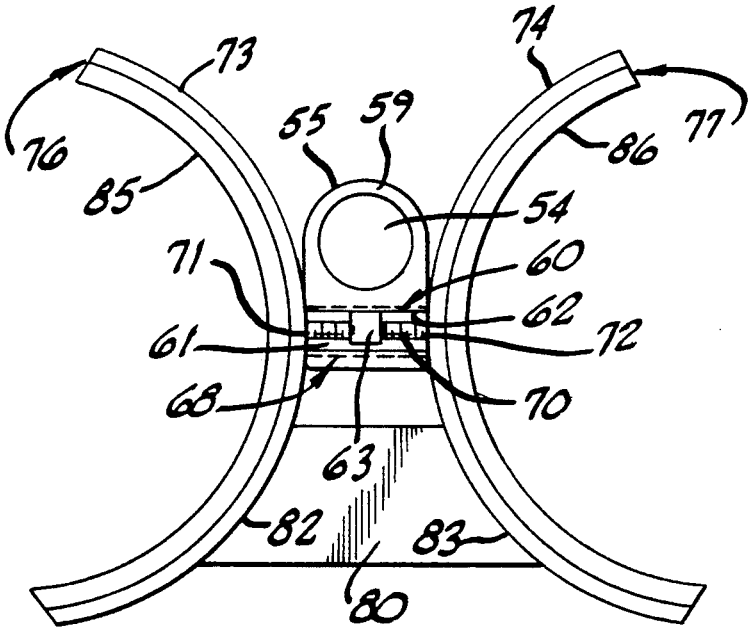
FIG. 8 is a rear elevational view of the thigh support members aligned perpendicular to the shaft axis, and the integrated collar and pivot assembly retainer housing, of the FIG. 1 embodiment.
Figure 7:
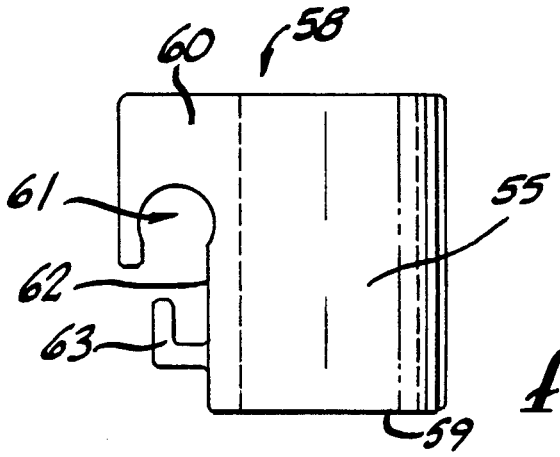
FIG. 7 is a side elevational view of an integrated collar and pivot assembly retainer housing, of the FIG. 1 embodiment.

As shown in FIGS. 7 and 8, the collar portion 55 includes a lower end surface 59, and the housing 58 includes a pivotable anchor retainer portion 60 having a concave recess 61, and a planar surface 62 which integrally includes second hook 63. Again referring to FIG. 3, a second end 65 of the elastic band 52 is looped over the hook 63. Although the preferred embodiment employs hooks as means to retain the band 52, other conventional means to clasp, clamp or otherwise retain the ends of the elastic band are equivalent means to accomplish this function within the scope of the present invention.

Figure 9:
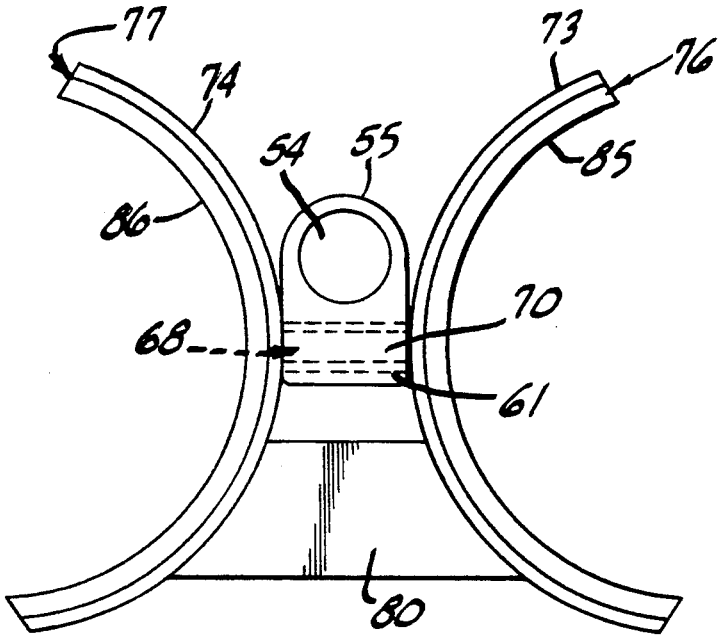
FIG. 9 is a front elevational view of the thigh support members aligned perpendicular to the shaft axis, and the integrated collar and pivot assembly retainer housing, of the FIG. 1 embodiment.

Referring to FIGS. 8, 9 and 10, a pivot sub-assembly 68 includes a cylindrical axle 70, preferably fabricated from a rigid plastic material such as ABS or polypropylene. Axle 70 has opposed first and second ends 71 and 72, disposed and smoothly rotatable within the concave recess 61 of the pivot sub-assembly retainer portion 60. To prevent binding of the axle 70 within the recess 61, the axle and the housing 58 are preferably fabricated from slidable materials. Alternatively, roller bearings or alternative conventional means may be employed to permit smooth rotation of the axle 70 within the recess 61. The axle ends 71, 72 are integrally attached, respectively, to first and second rigid member portions 73 and 74 of first and second arcuately-shaped thigh support members 76 and 77. A rigid cross-piece member 80 includes opposed first and second ends 82 and 83 integrally connected, respectively, to the member portions 73, 74. The cross-piece 80 extends between the member 76 and 77 and maintains them in fixed positions with respect to each other. First and second thigh contact padded members 85 and 86, preferably fabricated from a resilient rubberized foam material such as conventional polyurethane foam, are rigidly attached, respectively, to the rigid member portions 73, 74. Taken together, the pivot sub-assembly and the thigh support members form a pivotable anchor sub-assembly which provides an anchor to the body as well as a pivot to permit the crunch motion during use. The pivot, in use, always operates at a position intermediate the ends of the shaft 32, thereby permitting the restoring force of the band to operate through the pivot both from below the pivot as well as above the pivot.

As shown in FIG. 10, the axle 70, the rigid member portions 73, 74, and the cross-piece member 80 are preferably fabricated as a single unit 88, and preferably from a rigid plastic material such as polypropylene or ABS, or any other rigid material.

Referring to FIG. 8, pivot sub-assembly 68, the thigh support member and the cross-piece, function to help provide secure holding of the device between the thighs of the user and together with bore 54 in housing 58 permit free reciprocation of the shaft 32 during exercise using the device to perform the crunch motion. The pivot assembly 68 may be of integral construction or may be formed from a sub-assembly of component parts. The pivot sub-assembly and the housing 58 together provide for secure holding of the housing in a fixed position to the body while permitting rotation of the shaft through the pivot about axle 70 in an arc along an axis which is perpendicular, or orthogonal to the first and second axes as defined above, during reciprocation of the shaft during use of the device. The locus of points traced by a point on the upper region, that is, above the pivot point, of shaft 32 will be a complex arc corresponding to the complex arc generated by a corresponding intervertebral joint as the crunch motion is accomplished. Thus, the combination of anchor support, free sliding of the shaft and pivotal motion of the shaft, permits the user to execute a genuine "crunch" motion during exercise. By permitting a rocking of the cylindrical housing and shaft, and by permitting free sliding of the shaft 32 against the resistive force of the band 52 during use of the exercise device, the abdominal muscles are exercised under stress throughout the full range of motion. This motion is identical to the motion of the abdominal muscles and spine in a natural crunch motion of the individual, without the device. In essence, the device of the present invention permits safe loading of the abdominal muscles during exercise, without distorting the natural motion of the spine.

Thus, the anchor sub-assembly functions to permit rotation of the shaft and handle sub-assembly about instantaneous axes of rotation in such a fashion so as to permit a backward and forward bending of the torso of the person performing the exercise in a fashion which is equivalent to the motion of the spine and the abdominal muscles during the natural crunch motion. The instantaneous axis of rotation of each point of the upper region of the shaft changes from instant to instant because the length of the shaft above the pivot point changes and the instantaneous pivot angle changes in response to movement of the spine.

Where used here to describe the first preferred embodiment, the terms "integrally attached" or "integrally includes" mean that the parts referred to are portions of a single unit, preferably a plastic material and formed using an injection-type fabrication process. However, other forms of attachment may be suitable, consistent with minimizing production cost and enhancing reliability. The term "rigidly connected" means that the parts referred to, preferably made of tubular-shaped plastic material, after being closely fitted, are bonded by an adhesive. The term "rigidly attached" means that the parts referred to are screwed, glued or otherwise fastened together.

Figure 11:
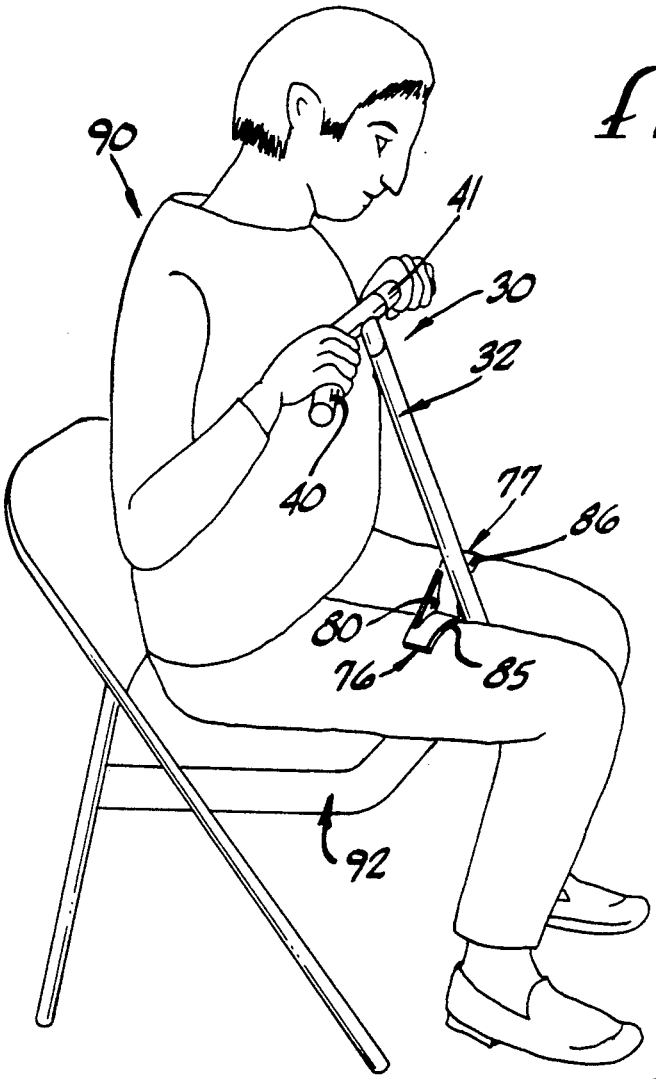
FIG. 11 illustrates a mode of operational use of the FIG. 1 embodiment, wherein a user sitting on a chair with the upper body upright and with the thigh support members positioned between the thighs is beginning a downstroke of the shaft.
Figure 12:
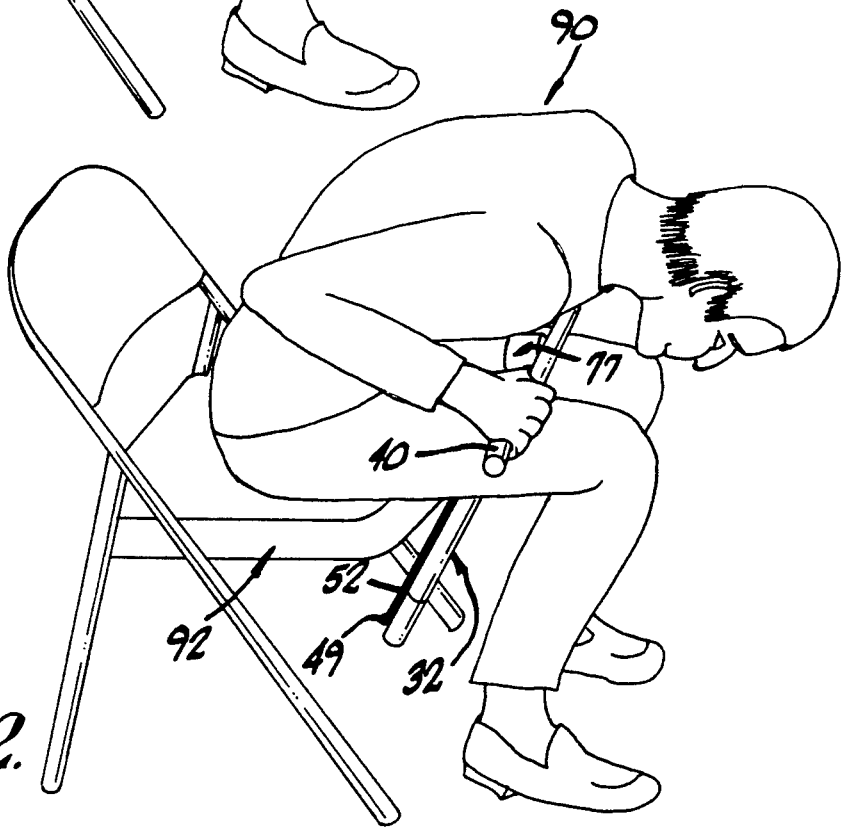
FIG. 12 illustrates a mode Of operational use of the FIG. 1 embodiment, wherein the user in FIG. 11 has completed a downstroke of the shaft, the shaft being at its extreme downward position and the angle of the shaft with respect to the vertical having changed as a result of pivoting of the axle in FIGS. 8 and 10.

Referring to FIGS. 11 and 12, operation of the exercise device of the present invention will be described. A person 90 is shown sitting in a chair 92, with the exercise device 30 positioned to perform sit-ups and/or rotary sit-ups. The shaft 32 is shown in an extended position, such that the elastic band 52 is relaxed, that is, unstretched. As also shown in FIGS. 11 and 12, the hands of the person are shown grasping the handles 40 and 41, although for specific exercises it may be preferred that the person keeps the hands open, that is, does not grasp the handles 40 and 41, but rather simply rests the open palms on the top surfaces of the handle members 40 and 41, keeps the hands and arms in a rigid position, and thus pushes the shaft 32 downward solely through rotation or bending of the trunk downward. In executing the downward motion, the shaft 32 not only moves from the up position as shown in FIG. 11, to the down position of FIG. 12, it also rotates in an arc about the axis of rotation defined by the center line of axle 70, with each point on the shaft tracing out a complex curve or arc corresponding to points along the spine. After the downward stroke is completed, the body is relaxed and elastic band 52 returns shaft 32 to its original position. Repeated cycles of this motion creates reciprocation of this shaft 32.

In addition to using the exercise device of the present invention while sitting on a chair, the person could use the device to perform knee-ups or crunches while lying on a floor with knees facing upward and bent, by using the same motions as described above.

After selecting an elastic band appropriate to the person's strength and fitness, the person would attach the band 52 between the hooks 49 and 63, as shown in FIG. 3, and then orient the device so that the hooks and attached elastic band were generally on the interior side of the device, i.e. disposed facing the body, with the thigh support members 76, 77 oriented so that the cross-piece member so is located above axle 70, as shown in FIG. 11. The padded portions 85, 86 of the thigh support members 76, 77 are positioned on the thighs, and then the thighs are firmly compressed, thereby maintaining the thigh support members firmly in position.

When using the exercise device to exercise the abdominal muscles by doing sit-up or rotary sit-up type exercises, a relatively stronger band 52 is preferably chosen, compared to a band chosen for knee-ups.

Referring again to FIG. 11, the person, having initiated the crunch conformation by tightening the abdominal muscles, is about to start a downward stroke by pressing down on the handle members 40, 41 with their chest while the upper trunk bends forward as the shaft 32 pivots about the axle 70, which as the downward stroke of shaft 32 is completed, rotates within the recess 61. Referring to FIG. 12, the handle members 40, 41 are fully depressed, the shaft 32 and band 52 being maximally displaced with respect to the block-shaped housing 58, resulting in maximum resistive force being generated by band 52. The upper torso is also fully bent with the abdomen maintaining the crunch conformation.

To prepare for the next downstroke, the person relaxes and sits up so that the handle will return due to the upward displacement of the shaft caused by the restoring force of the elastic band 52. The return displacement of the shaft is limited, or stopped, by the upper end surface 50 of the cylindrical housing 45 (FIG. 4) contacting the lower end surface 59 of the collar portion 55 (FIG. 7). As is also shown in FIG. 11 compared to FIG. 12, the angle of the shaft 32 with respect to vertical is different, illustrating the rotation of the shaft about the pivot point, or axle, as the crunch movement is executed. In FIG. 11, it may be seen that the shaft forms an angle to the left of vertical when the person is sitting upright, about to begin the exercise. As the person performs the crunch motions, the shaft 32 pivots about axle 70 so that when the downstroke is completed, the angle formed by the shaft 32 is to the right of vertical, as illustrated in FIG. 12.

Second Preferred Embodiment

Figure 13:
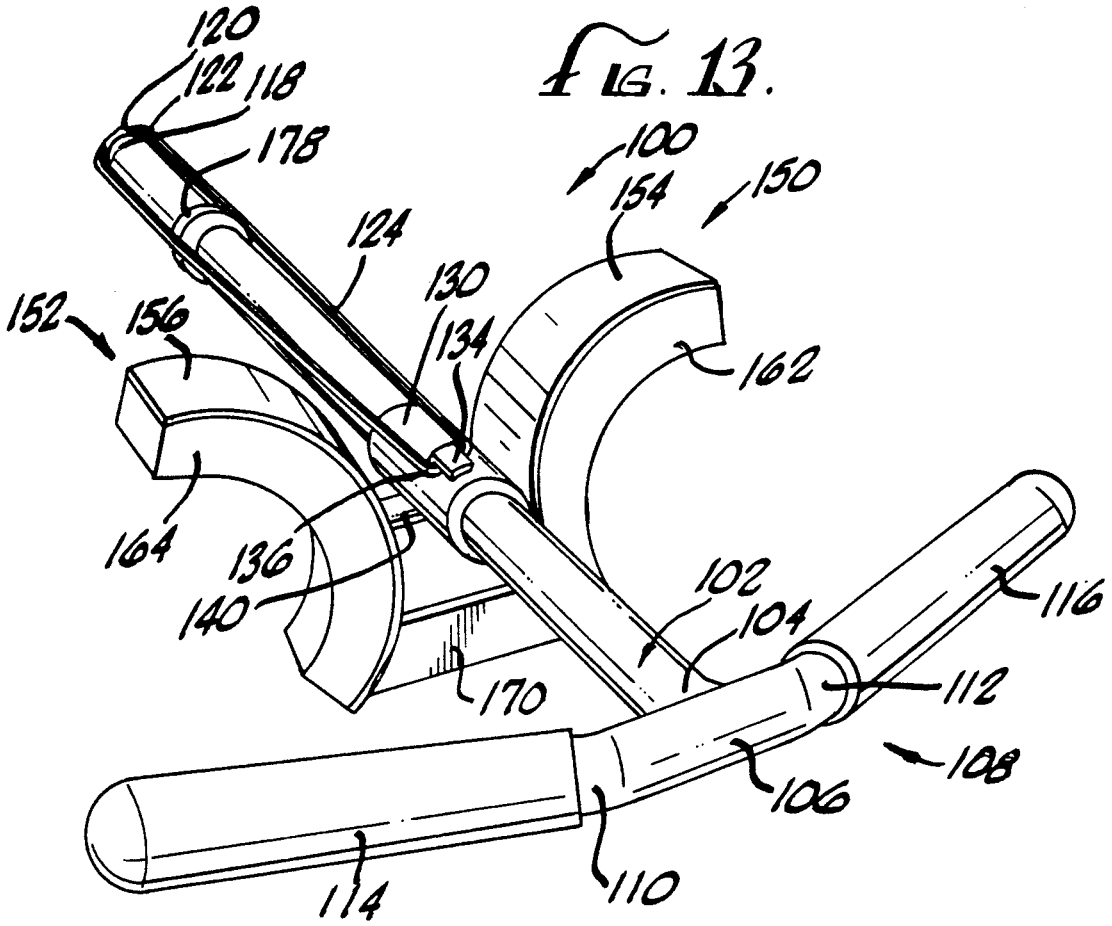
FIG. 13 is a perspective view of a second preferred embodiment.
Figure 14:
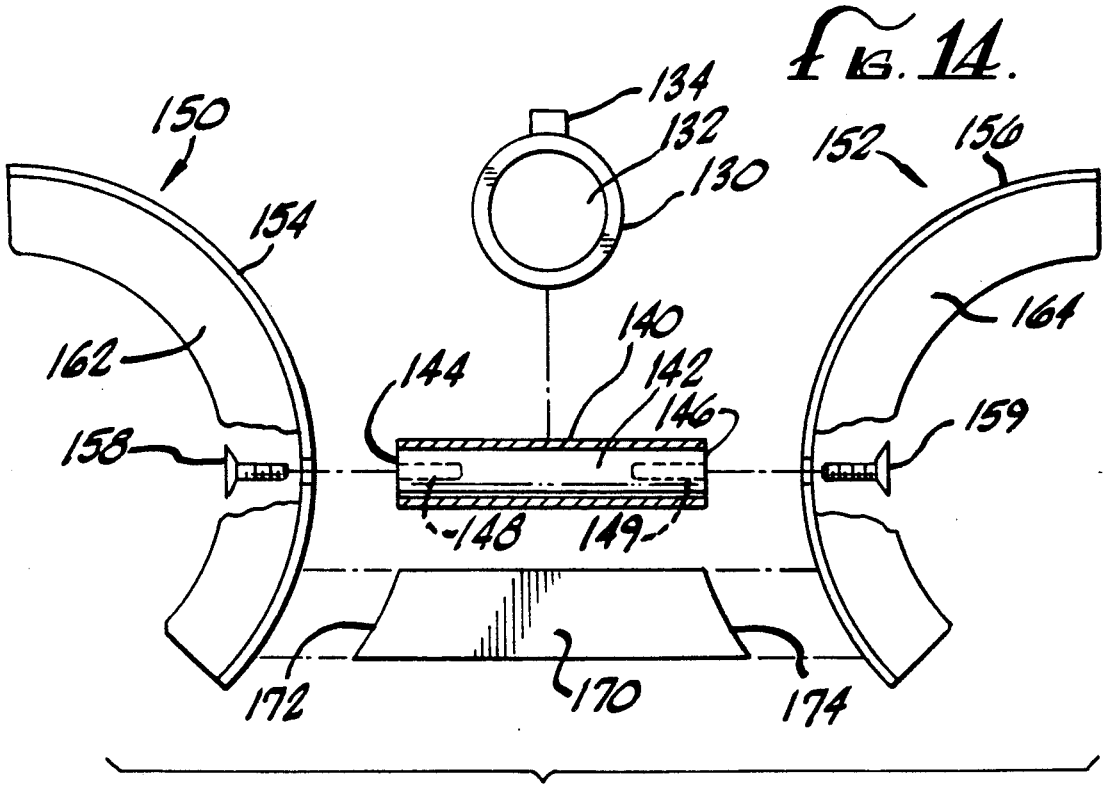
FIG. 14 is an exploded cross-section view of a collar, a pair of thigh support members, and a pivot assembly comprising a housing and bushing, of the FIG. 13 embodiment.

The second embodiment will be described with reference to FIGS. 11–17. As shown in FIGS. 13 and 14, an exercise device 100 includes a rigid generally tubular shaft 102, preferably made of a metal, wood or plastic rigidly attached at a first end 104 to a generally transverse mid-section 106 of a rigid push-bar 108 which extends generally downward in opposed first and second handle members 110, 112. The handle members 110, 112 are covered, respectively, with first and second hard rubber sheaths 114, 116 suitable for maintaining a secure yet comfortable hand-grip while exercising.

The shaft 102 terminates in a second end 118 to which is rigidly attached a conventional connector, a first hook 120 over which a first end 122 of an elastic band 124 is connected or looped. The shaft 102 is closely received and slidably disposed within a cylindrical housing 130 having a circular bore 132. Rigidly attached to the housing 134 is a second hook or other oonventional connections device 134 over which a second end 136 of the elastic band 124 is looped or otherwise connected.

The housing 130 is rigidly attached to a transverse tubular metal pivot housing 140 within which is disposed a rotatable bushing 142 having opposed first and second ends 144, 146 with, respectively, first and second screw-threads 148, 149. First and second thigh support members 150, 152 including, respectively, first and second arcuately-shaped metal portions 154, 156 are rigidly connected, respectively, to the bushing 142 by first and second metal screws 158, 159 inserted into the screw-threads 148, 149.

The arcuately-shaped metal portions 154, 156 are sized and angled so as to conform to the contours of the inner human thighs and thus function as a means to hold the exercise device between the thighs of a person. Rigidly connected and conforming to the metal thigh support member portions 154, 156 are arcuately-shaped first and second foam rubber portions 162, 164 which contact a user's thighs and cushions the force.

A metal cross-piece member 170 is rigidly attached at opposed first and second ends 172, 174 to, respectively, the thigh support member portions 154, 156. An annular metal ring 178 is rigidly attached to the shaft 102 approximately 4½ inches from the shaft end 8, the ring 178 serving to limit the upward movement of the shaft 102 as a user completes an upstroke.

Where used here to describe the second preferred embodiment, the term "rigidly attached" means that when the parts referred to are made of metal, they are preferably welded. However, other forms of attachment may be suitable, consistent with minimizing production cost and weight. The term "rigidly connected" means that the parts referred to are screwed, glued or otherwise fastened together.

The disposition and range of pivoting motion of the thigh support members 150, 152 with respect to the shaft 102 are illustrated in FIGS. 15 and 16. FIG. 15 shows the device 100 where the members 150, 152 are pivoted so as to generally lie in the plane defined by the length of shaft 102 and the length of push-bar 108. In FIG. 16, the members 150, 152 are shown pivoted so as to be perpendicular to the plane defined by the shaft 102 and the push-bar 108. As also illustrated in FIGS. 15 and 16, the handle members 110, 112 are at a slight angle less than perpendicular to the length of the shaft 102; however, handle members which extend perpendicular from shaft 102 are also preferred and therefore are considered to be equivalent.

FIG. 17 shows a detailed view of the tubular pivot housing 140 and the hook 134 rigidly attached to or integral with the cylindrical housing 130.

After selecting an elastic band having a strength or restoring force appropriate to the user's strength and fitness and to the type of exercise to be performed, a person using the exercise device 100 would attach the band 124 between the hooks 120 and 134. While sitting in a chair when about to perform sit-ups and/or rotary sit-ups, or lying on the floor with knees bent when about to perform leg-ups, the person would first orient the device so that the hooks and attached elastic band were generally on the superior side of the device, i.e. disposed away from the body, position the padded portions 162 and 164 of the thigh support members 150 and 152 at approximately the mid-section of the thighs, and then firmly compress the thighs thereby maintaining the thigh support members firmly in position. Exercises would be performed using the same procedures as described above for the first embodiment. In the second embodiment, the thigh supports and housing also remain fixed with respect to the person exercising, but permit reciprocation and rotation of the shaft so as to provide resistance to the abdominal muscles as the crunch motion is performed, similar to that permitted in the first embodiment device.

Third Preferred Embodiment

The third embodiment will be described with reference to FIGS. 18–23. An exercise device 200 includes a tubular metal shaft 210 rigidly connected at a first end 212 to a generally transverse mid-section 214 of an arcuately shaped rigid push-bar 216 having concavely downward opposed ends 218 and 220. The push-bar 216 preferably is covered with a resilient rubber material so as to provide a gripping surface.

The shaft 210 terminates in a second end 222 to which is rigidly connected a cap 224 of hard plastic material and including a rounded bottom surface 226. The cap 224 serves to prevent marring of a surface such as furniture or a floor should the shaft end 222 be inadvertently scraped across the vulnerable surface. A projection 230 rigidly connected to the shaft 210 approximately one inch from the end 222 is connected to a first end 234 of an elastic band 236.

Figure 22:
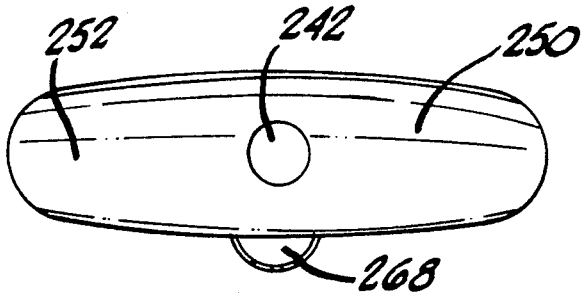
FIG. 22 is a top plan view of the FIG. 20 yoke.
Figure 23:
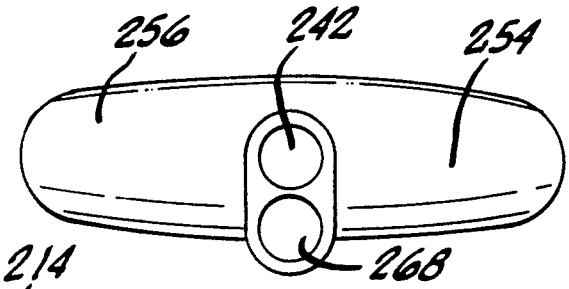
FIG. 23 is a bottom plan view of the FIG. 20 yoke.
Figure 19:
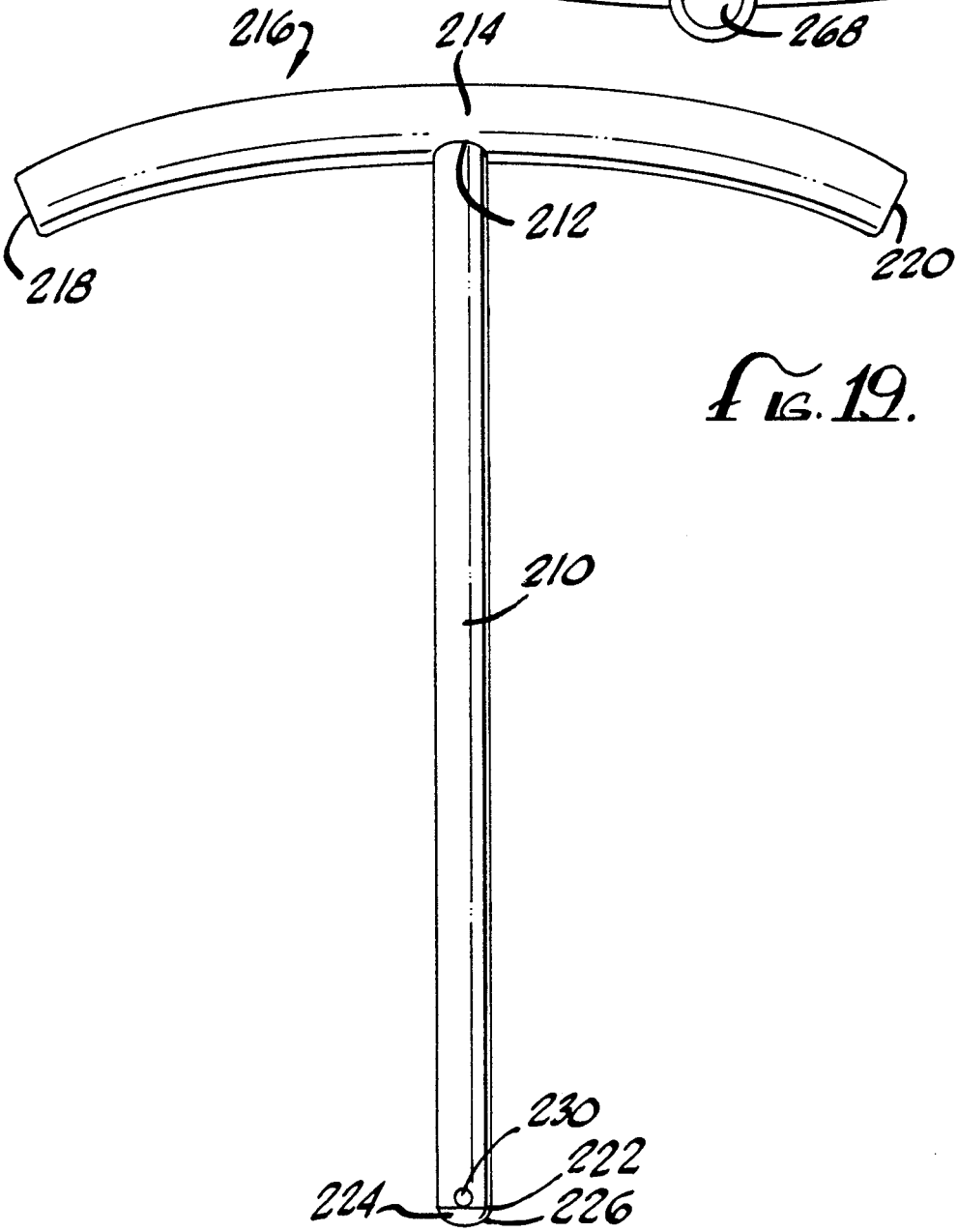
FIG. 19 is a plan view of a slidable portion of the FIG. 18 embodiment, including a handle, a tubular shaft, an end-cap, and a projection for connecting an elastic band.

The shaft 210 is closely received and slidably disposed within a yoke 240 having, as shown in FIGS. 22 and 23, a cylindrical bore 242 extending longitudinally therethrough.

As shown in FIGS. 18, 20 and 21, the yoke 240 includes an upper portion 244 including opposed generally horizontal arcuately shaped flanges 246 and 248, the flanges 246, 248 including, respectively, a concavely shaped upper surface 250 and 252, and a lower surface 254 and 256, the lower surfaces 254, 256 having distal portions and 260, respectively, convexly curved in the front-to-rear direction when resting transversely across a user's thighs, and concavely curved at the junction 262 of the upper yoke portion 244 with a vertical lower yoke portion 264, so as to generally fit the contour of the inner human thighs.

Referring to FIGS. 18, 22 and 23, the lower yoke portion 264 has a generally ellipsoidal shape and includes a longitudinal channel 268 extending therethrough. At upper end 270 of channel 268, as shown in FIGS. 18, 20 and 21, is a finger 272 over which a second end 274 of the elastic band 236 is looped. The upper end 270 of channel 268 has an open region, shown at 271 where the finger 272 projects and through which a second end 274 of elastic band 236 may be looped over finger 272, with the first end 234 of the band and its remaining length being inserted and fed down through channel 268 so that it extends out the bottom and hooks over projection 230 as shown in FIG. 18.

Where used here to describe the third preferred embodiment, the term "rigidly connected" means that the parts referred to are screwed, glued or otherwise fastened together.

After selecting an elastic band appropriate to his or her strength and fitness, a person using the exercise device 200 attaches the band 236 between the projection 230 and the finger 272. While sitting in a chair when about to perform sit-ups and/or rotary sit-ups, or lying on the floor with knees bent when about to perform leg-ups, the person would first orient the device 200 so that the channel 268 pointed away from the body, and then position transversely across the upper thighs the lower surfaces 254 and 256 of the upper yoke portion 244, firmly squeezing the lower yoke portion 264 between the lower thighs, thereby firmly positioning the yoke 240 with respect to the upper thighs.

Pivoting of the device so as to enable maintaining the crunch conformation is accomplished by means of a change of angle of the convexly shaped portions 258, 260 of the surfaces 254, 256 with respect to the anterior surfaces of the upper thighs as the downstroke is executed. Exercises are performed as described previously in conjunction with the first preferred embodiment. Thus, it may be seen that the surfaces 254, 256 provide the means by which the shaft 210 is rotated about an axis during reciprocation of the shaft during execution of the crunch technique.

What is claimed is:

1. An exercise device comprising:

a rigid shaft having a first end, a second end and a length along a first axis;

a handle attached to the first end of the shaft and extending along a second axis perpendicular to the first axis;

an elastic band capable of being stretched to a length substantially equal to the length of the shaft;

a retainer sub-assembly positioned on the shaft and adjacent the second end of the shaft comprising:

a stop member and a first elastic band retainer, the stop member adapted to stop movement of the shaft during upstroke of the shaft and maintain the elastic band retainer rigidly positioned with respect to the shaft and the elastic band retainer adapted to retain one end of the elastic band;

an anchor sub-assembly slidably disposed along the shaft between the first end and the second end of the shaft and comprising:

a housing having a bore adapted to permit sliding of the anchor sub-assembly over the length of the shaft between the first end of the shaft and the retainer sub-assembly during reciprocating motion of the shaft with respect to the housing;

a second elastic band retainer rigidly positioned with respect to the anchor sub-assembly and adapted to retain a second end of the elastic band; and a pivotable anchor comprising:

a first member adapted to rest against the left thigh of a user;

a second member adapted to rest against the right thigh of the user; and a pivot axle positioned in the anchor sub-assembly along an axis of rotation generally parallel to the second axis;

whereby the shaft and handle are rotated about the pivot axle and in an arc along a third axis orthogonal to the first and second axes as the shaft is reciprocated through the bore of the housing along the length of the shaft by the user.

2. An exercise device adapted for use by a person comprising:

a rigid shaft having a first end, a second end, and a predetermined length;

a handle generally transverse to and attached to the first shaft end;

a housing having a bore therethrough and slidably retaining said rigid shaft, the bore having a first end facing the first end of the shaft and a second end facing the second end of the shaft;

two members adapted for resting the device against the thighs of the person and for maintaining the housing between the thighs of the person;

means for generating a resistive restoring force as the shaft moves relative to the housing in a direction from the first shaft end to the second shaft end;

means for pivoting the shaft in a direction away from the torso as the person presses on the handle, said means for pivoting being positioned on the device and intermediate the first end and second end of the shaft; and means for limiting the displacement of the shaft relative to the housing, as the shaft moves in a direction from the second shaft end to the first shaft end.

3. The exercise device of claim 2, wherein said members adapted for maintaining said housing between the thighs comprises first and second thigh support members rotatably attached to the housing.

4. The exercise device of claim 3 wherein said first and second thigh support members have a rigid member therebetween.

5. The exercise device of claim 2, wherein said means for maintaining said housing stationary with respect to a person's lower torso comprises a yoke having:

a first portion including generally opposed first and second flanges; and a second portion generally orthogonal to said flanges.

6. The exercise device of claim 5, wherein said first flange and said second flange each include a convexly curved lower surface.

7. The exercise device of claim 2, wherein said means for the shaft to move through and relative to the housing comprises a bore extending longitudinally through the housing, the shaft being slidably disposed within the bore.

8. The exercise device of claim 2, wherein said means for generating a resistive restoring force comprises an elastomeric band.

9. The exercise device of claim 2, wherein said means for pivoting the shaft away from the torso comprises:

an axle including first and second opposed ends; and means for rotating the axle with respect to the housing.

10. The exercise device of claim 2, wherein said means for pivoting the shaft away from the torso comprises a yoke having:

a first portion including generally opposed first and second flanges, the flanges each having a convexly curved lower surface; and a second portion generally orthogonal to the first portion.

11. An exercise device adapted for use by a person comprising:

a rigid shaft having a first end, a second end, and a predetermined length;

a handle connected to the first shaft end;

a housing including a collar portion and a pivot assembly retainer portion, the collar portion including a bore within which the shaft is slidably disposed, and the pivot assembly retainer portion including a recess and a first hook, the hook disposed on the generally inferior side of said portion when the device is positioned for use;

a pivot assembly including an axle rotatable within said recess and about an axis of rotation;

first and second thigh support members adapted to rotate about the axis of rotation;

a cross-piece member extending from the first to the second thigh support member and rigidly connecting the first and second thigh support members to each other;

a housing attached at the second shaft end, the housing connected to a second hook, the hook being disposed on the generally inferior side of the housing when the device is positioned for use; and an elastomeric band connected between the first and second hooks.

* * * * *